US006592474B1

(12) United States Patent
Halsworth

(10) Patent No.: US 6,592,474 B1
(45) Date of Patent: Jul. 15, 2003

(54) POWER SWING TRAINING BAT

(76) Inventor: Robert M. Halsworth, 23207 Stelling Ave., Port Charlotte, FL (US) 33980

( * ) Notice: Subject to any disclaimer, the term of this patent is extended or adjusted under 35 U.S.C. 154(b) by 0 days.

(21) Appl. No.: 10/187,243

(22) Filed: Jul. 2, 2002

Related U.S. Application Data

(63) Continuation-in-part of application No. 10/087,284, filed on Mar. 1, 2002.

(51) Int. Cl.[7] ..... A63B 69/00
(52) U.S. Cl. ..... 473/453; 473/422; 482/121
(58) Field of Search ..... 473/453, 417, 473/451, 461, 422, 457, 423, 473; 482/121, 124

(56) References Cited

U.S. PATENT DOCUMENTS 2,134,451 A * 10/1938 Mogren ..... 482/94

* cited by examiner

*Primary Examiner*—Paul T. Sewell
*Assistant Examiner*—M. Chambers
(74) *Attorney, Agent, or Firm*—Frank A. Lukasik

(57) ABSTRACT

The power swing training device of the invention is a tethered, truncated, training device attached by flexible elastic to a fixed anchor point, or to a pulley and weight system. A swivel attachment is attached to the distal end of the training device and a flexible yoke is attached to the swivel attachment, and an elastic cord is attached to the yoke at one end and to a fixed point at the other. In a second embodiment, a cord is hung on a pulley attached to an anchor and a weight is placed at the other end.

5 Claims, 13 Drawing Sheets

POWER SWING TRAINING BAT

RELATED INVENTIONS

The instant invention is a Continuation-In-Part of Ser. No. 10/087,284, Filed Mar. 1, 2002.

BACKGROUND OF THE INVENTION

The present invention relates to sports training devices and more particularly to a tethered training bat or other sports equipment attached by flexible elastic to a fixed anchor point, or to a pulley and weight system.

DESCRIPTION OF THE PRIOR ART

Prior art training bat devices are designed to accomplish one of the two basic purposes, to train a batter's muscles to swing the bat correctly, to develop the batter's muscles and improve batting strength and velocity. General batting practice using a pitcher or a pitching machine is sometimes inefficient particularly with newer players who may be unable to hit the ball. In this case, the batter gets little accuracy or muscle strength training. A pitching machine is a good device, however, it doesn't add any resistance to the swing and does not strengthen the muscles to give a more powerful swing.

The following patents are examples of prior art devices: U.S. Pat. No. 6,030,299 to Denny discloses a suspended ball held by a flexible, resilient plate giving resistance to the batter's swing, does offer a training and strengthening device but is mechanically complex and costly to build; U.S. Pat. No. 6,050,908 to Muhlsen discloses a training bat having a handle member with a shock absorbing coupler and at least one detachable elongated contact surface member coupled in the shock absorbing coupler wherein at least one detachable elongated contact surface member has a width significantly less than the width of a regular bat to enhance the eye-to-hand coordination to contact a pitched ball; U.S. Pat. No. 5,595,384 to Hardison, Jr. discloses a bat swing guide including a vertical support member and an arcuate guide attached at one end to the vertical support member. The arcuate guide is generally semi-circular and may be positioned to accommodate either a righthanded or lefthanded hitter. A pivoting tee is attached to the vertical support member for supporting a ball. An adjustable bat stop is attached to the distal end of the arcuate guide; U.S. Pat. No. 5,014,984 to Brockhoff discloses a practice baseball bat having an elongated shaft of predetermined length. One end of the shaft has a hand-grip portion and an elongated, enlarged cylindrical ball contact portion which extends intermediate the ends of the shaft and adjacent the other end of the shaft.

None of the prior art devices provide a training and strengthening device which can be adjusted as to the direction or angle of the swing or by adding additional weights to gradually increase the strength of the body.

SUMMARY OF THE INVENTION

The present invention provides a truncated training bat or other sports device such as a tennis raquet, golf club or hockey stick, for example, having a coated steel wire yoke attached to its distal end. A flexible rubber cord (or multiples thereof) is attached by hooked ends to a yoke at one end and to a fixed base at the other. In a further embodiment, the bat is attached by a cord to a pulley and weight resistance system.

It is therefore an object of the invention to provide a new, improved, and inexpensive sports training device that strengthens the sportsman by using flexible, no impact, resistance.

A further object of the invention is to provide a training device which can be used anywhere there is a suitable attachment or suspension point.

A still further object of the invention is to provide a training device which can be adjusted to give greater or lesser resistance and by so doing, becomes useful to a wide age range of players.

Another object of the invention is to provide a handle dimensioned exactly as a normal sports device to familiarize the user with the feel of a regular device.

These and other objects and advantages of the present invention will be fully apparent from the following description when taken in connection with the annexed drawings.

DESCRIPTION OF A PREFERRED EMBODIMENT

Figure 1:
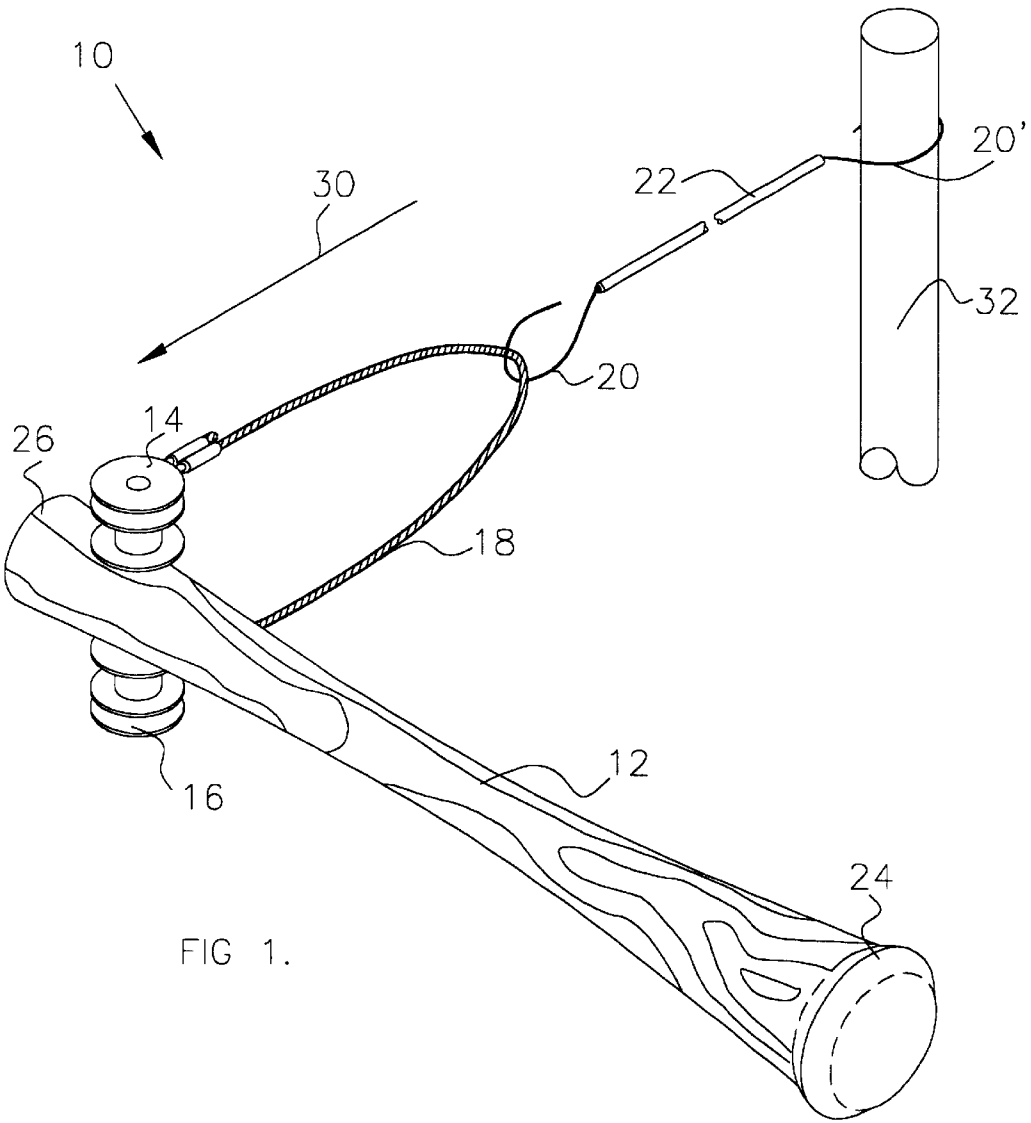
FIG. 1 is an isometric view of a first embodiment of the invention.

The training device of the invention is light in weight, is small enough to fit in any sports bag and can be attached and used almost anywhere a person feels like practicing their swing, at a home ,or on the field. It would be a great asset for any coach, and could be used by everyone from the boys and girls in T-Ball to the players in the pros.

Referring now to the drawings, wherein like numerals refer to like and corresponding parts throughout the several views, in FIGS. 1, 2, 3 and 4, the invention is designated overall by the numeral 10. Bat 12 has a proximal end 24 and a distal end 26. Swivel attachment points 14 and 16 connect yoke 18 to bat 12. The swivel attachment points 14 and 16 are each formed of washers 30 and spacers 31 mounted on shaft 35 to hold the yoke ends 32 in a rotatable position on shaft 33. The assembly of spacers and washers is fixed with a cotter pin 36. In a first embodiment, the Yoke ends 38 were formed in a loop and fastened with fasteners 34.

Hooks 20 and 20', attached at each end of cord 22, connect to fixed anchor 32, providing inertial force against the rotation of bat 12 in the direction of arrow 30.

Figure 2:
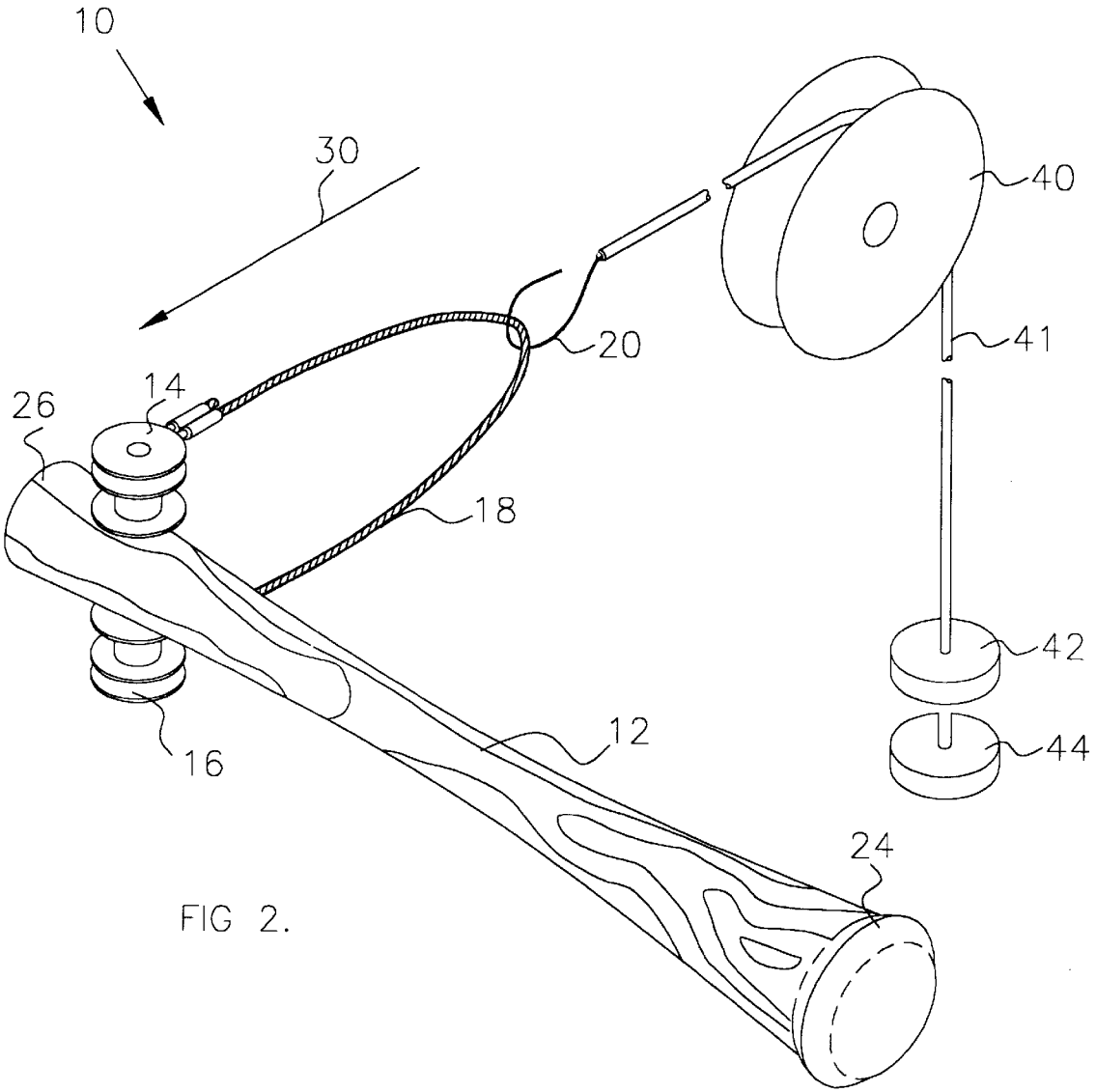
FIG. 2 is an isometric view of a second embodiment of the invention.

Referring to FIG. 2, in an alternative embodiment, base weights 42 and supplemental weight 44 apply tension to cord 41 and inertial force against the rotation of bat 12 in the direction of arrow 30.

Figure 5:
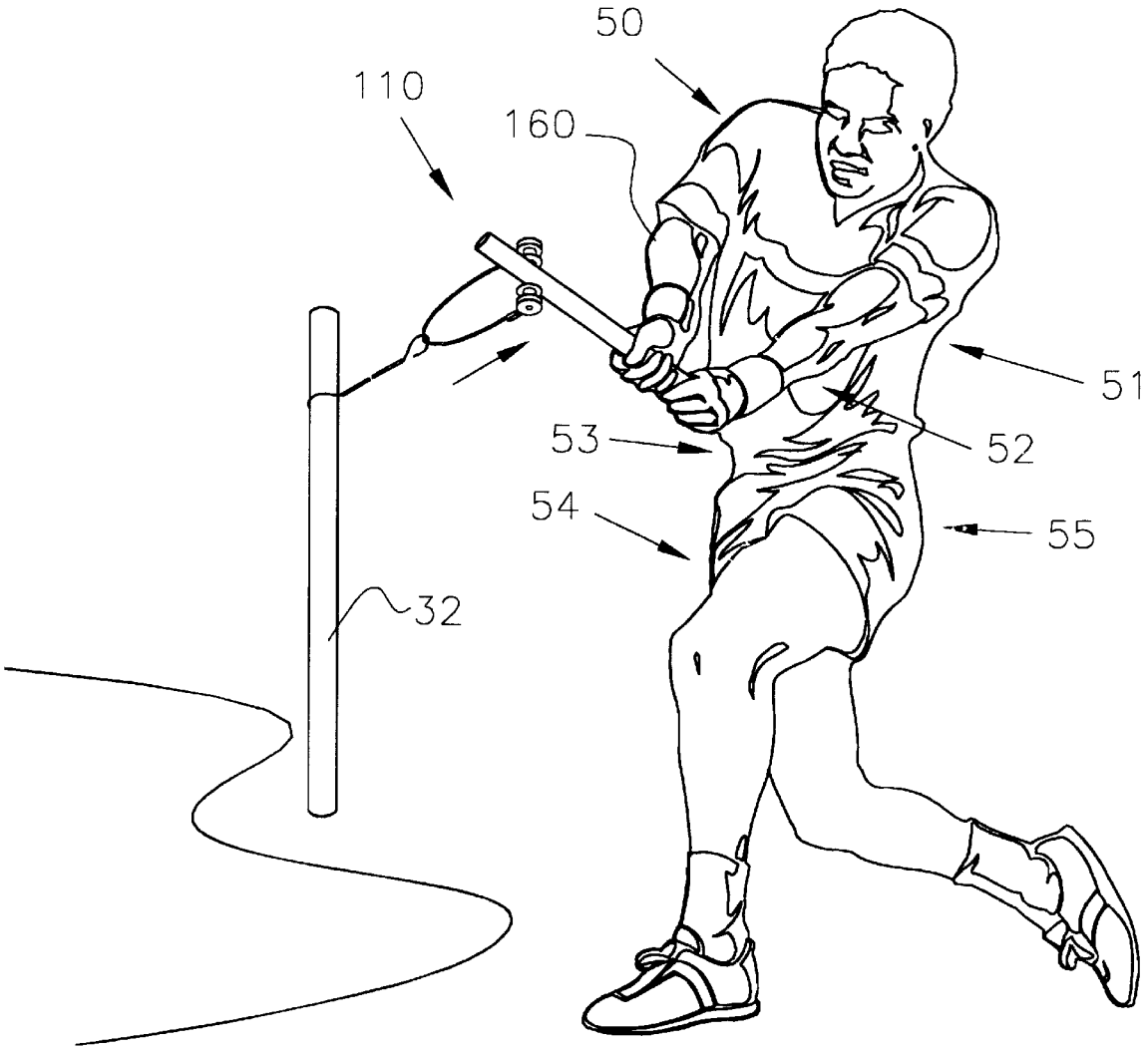
FIG. 5 is an. elevational view showing a tennis player using the training device of the invention.
Figure 6:
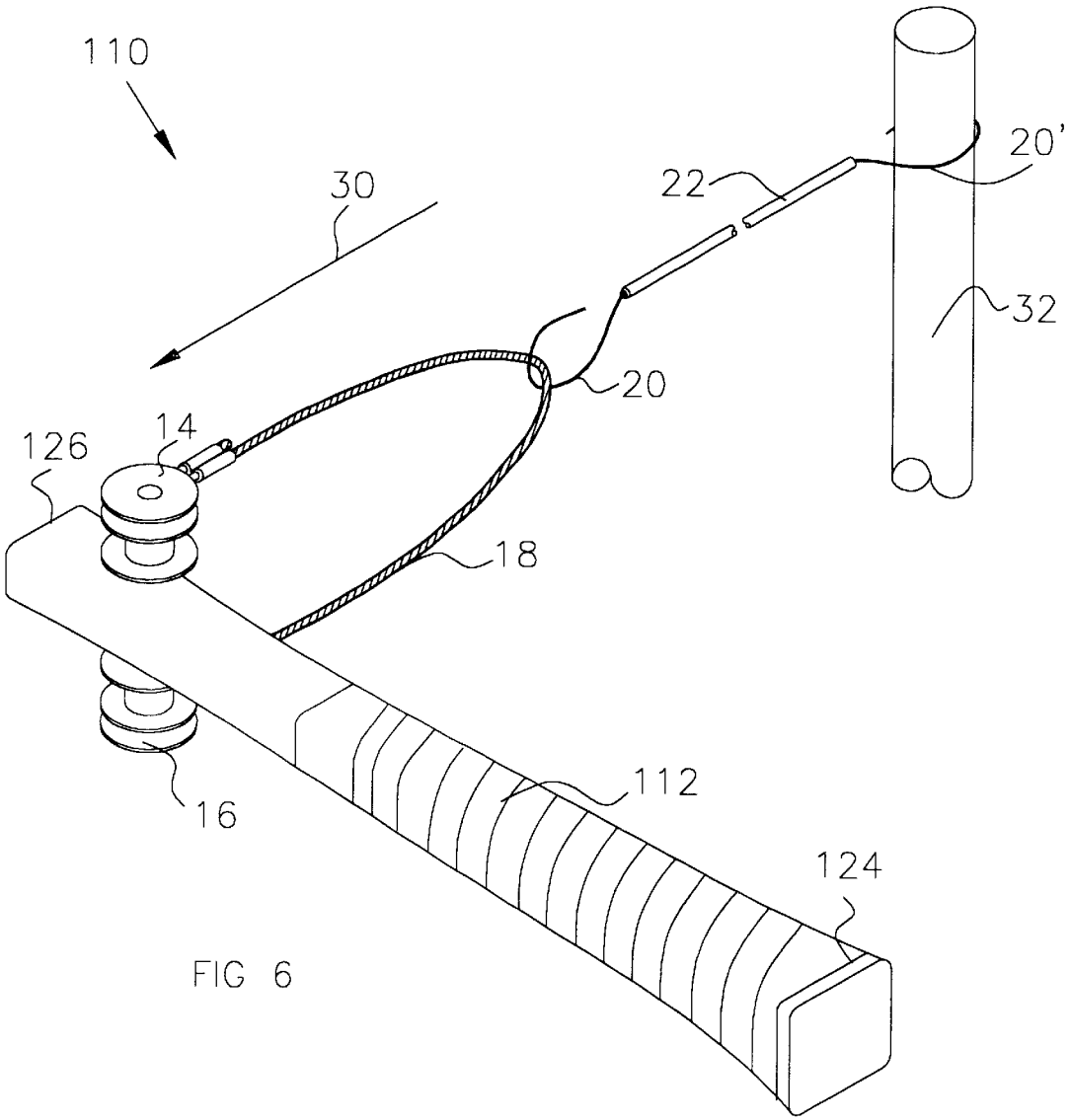
FIG. 6 is an isometric view of a first embodiment of a tennis raquet handle in accordance with the invention.
Figure 7:
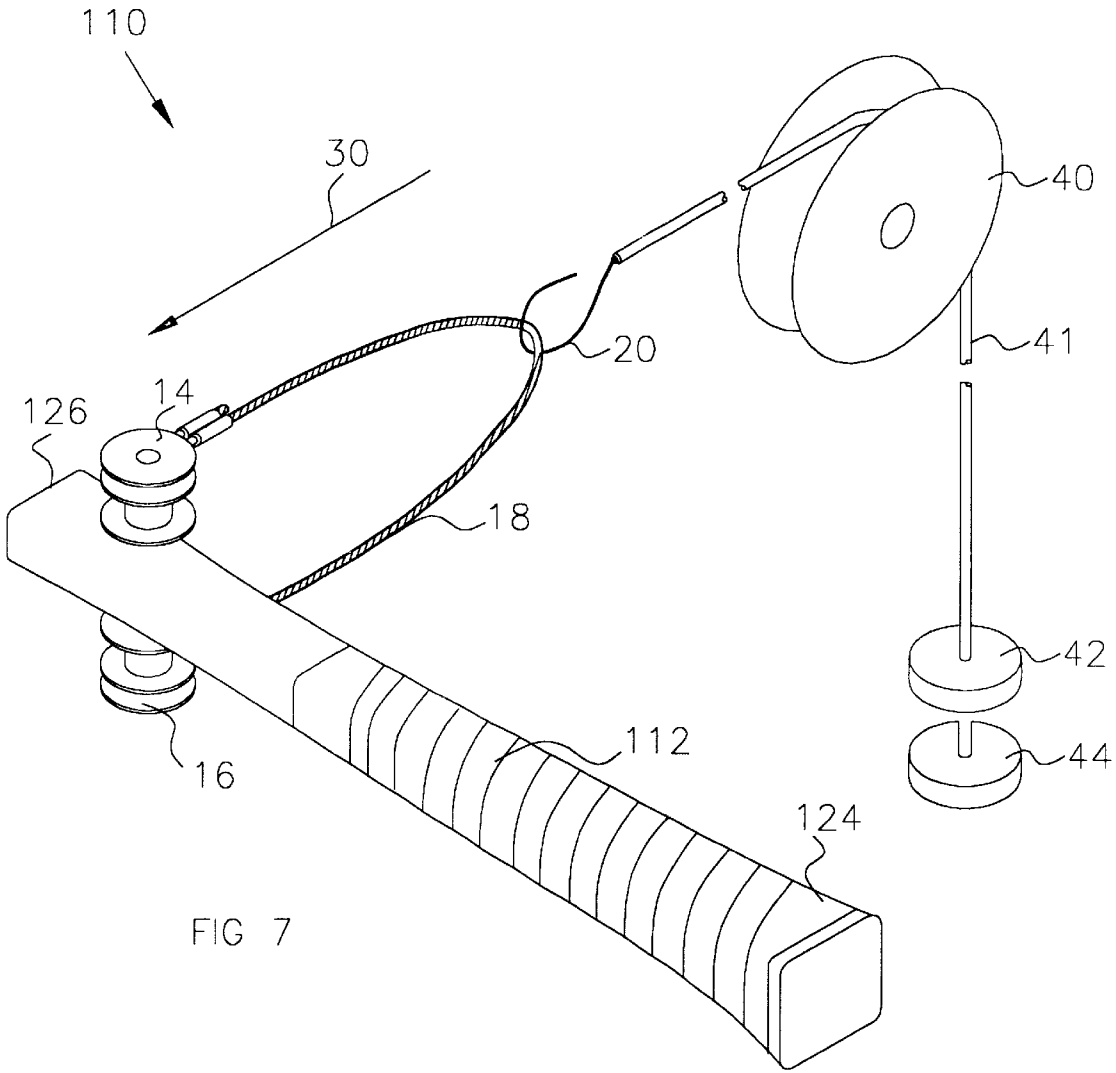
FIG. 7 is an isometric view of a second embodiment of a tennis raquet handle in accordance with the invention.
Figure 8:
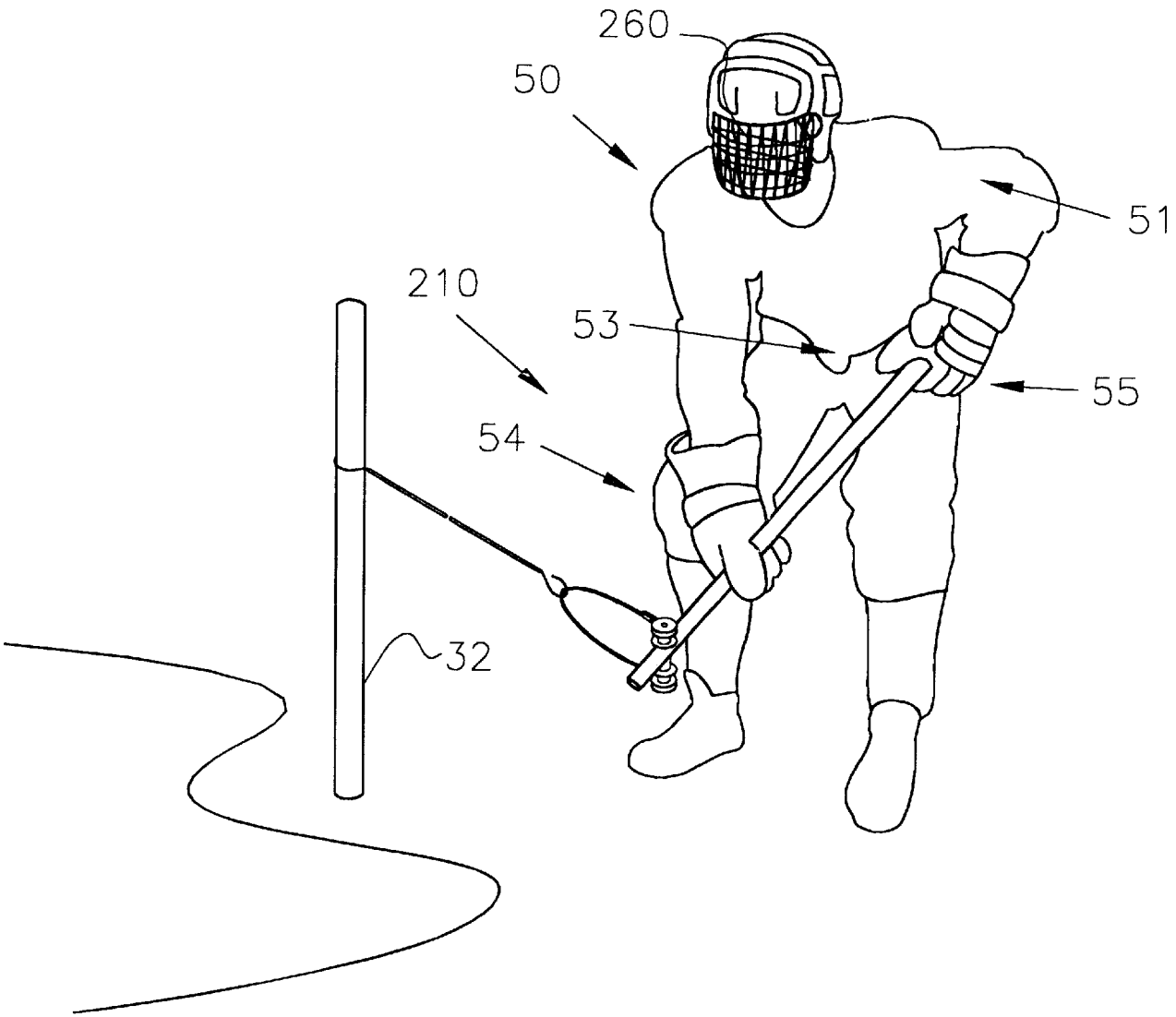
FIG. 8 is an elevational view of showing a hockey player using the training device of the invention.
Figure 9:
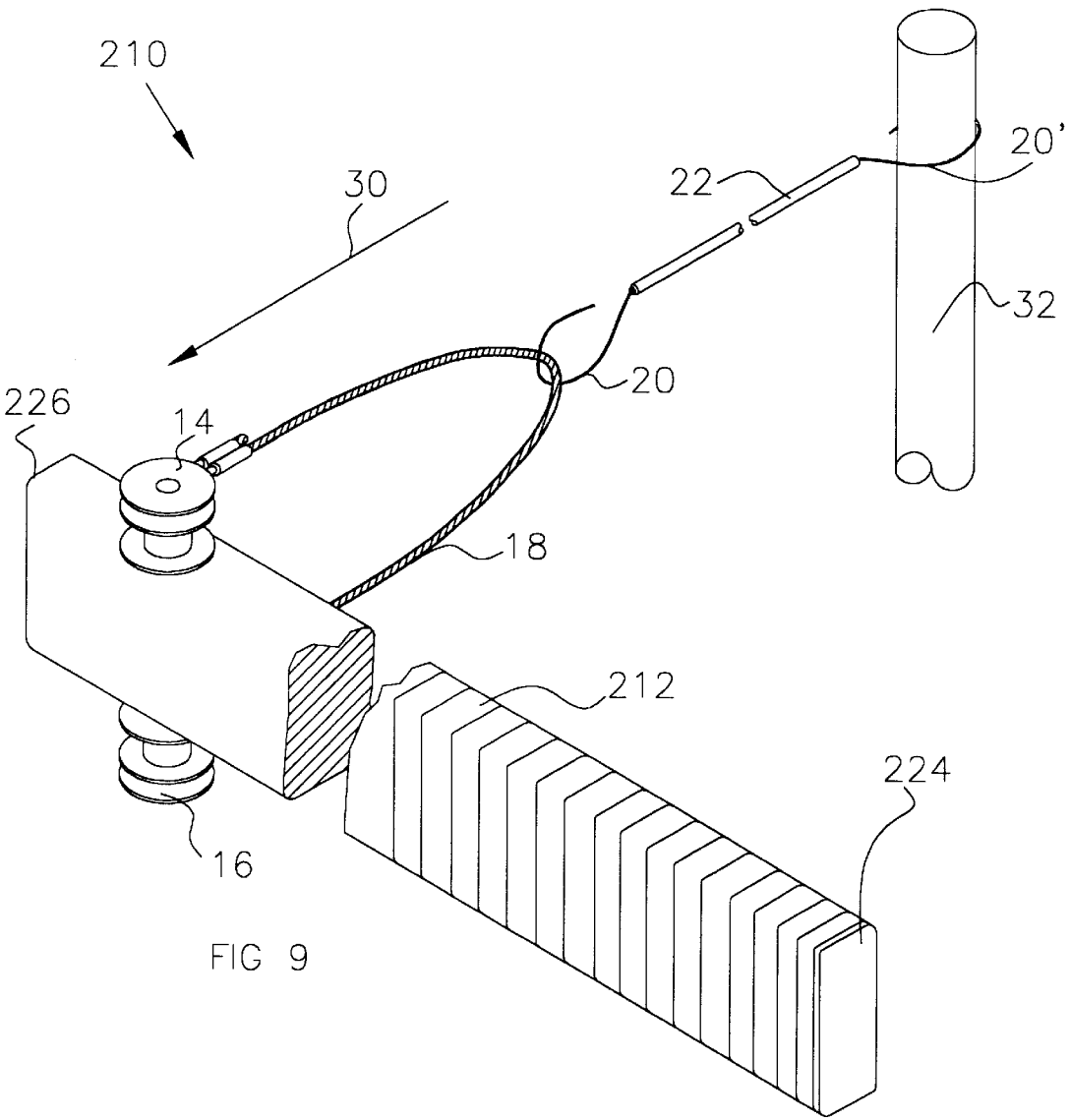
FIG. 9 is an isometric view of a first embodiment of a hockey stick handle in accordance with the invention.
Figure 10:
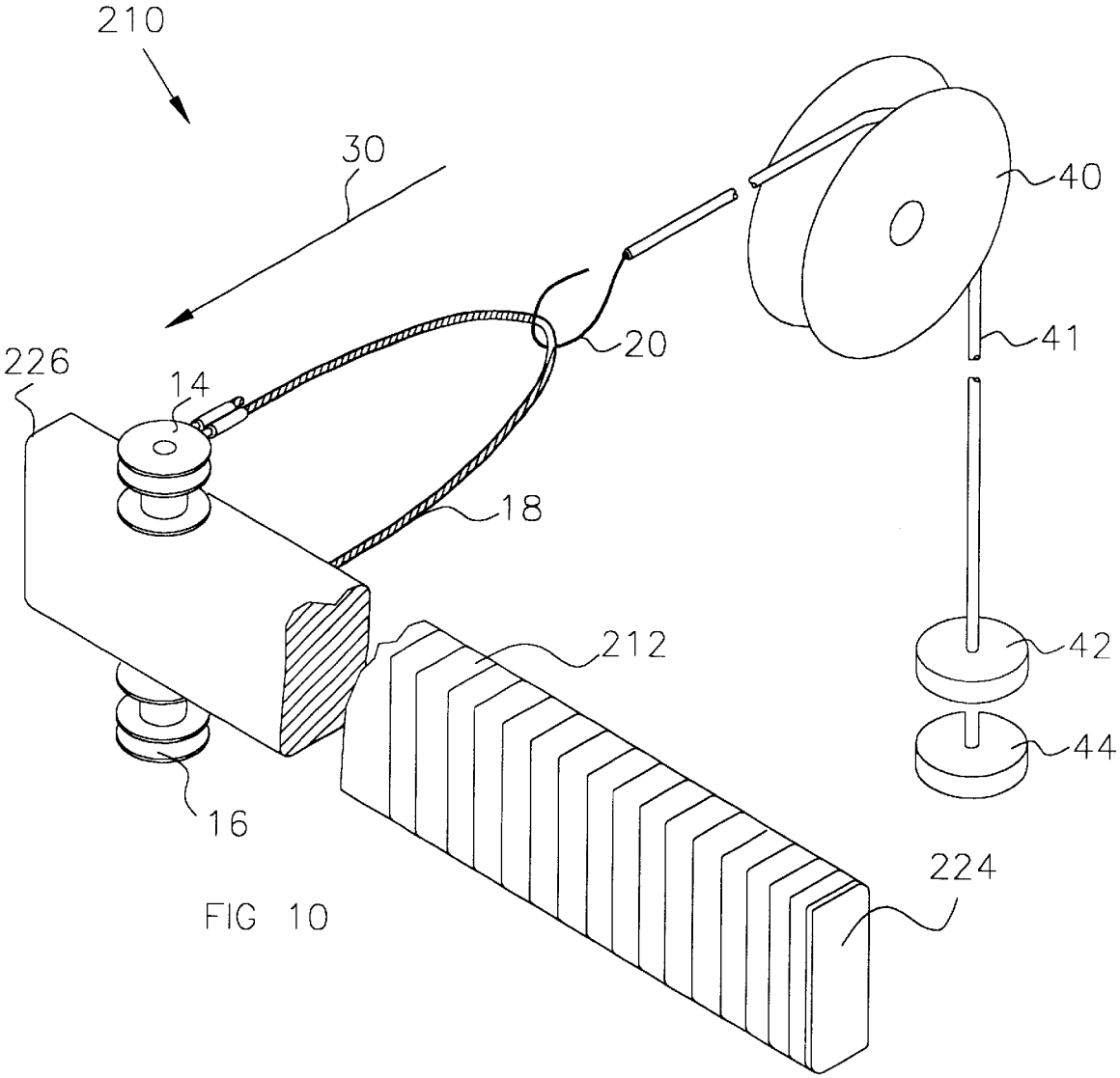
FIG. 10 is an isometric view of a second embodiment of ahockey stick handle in accordance with the invention.
Figure 11:
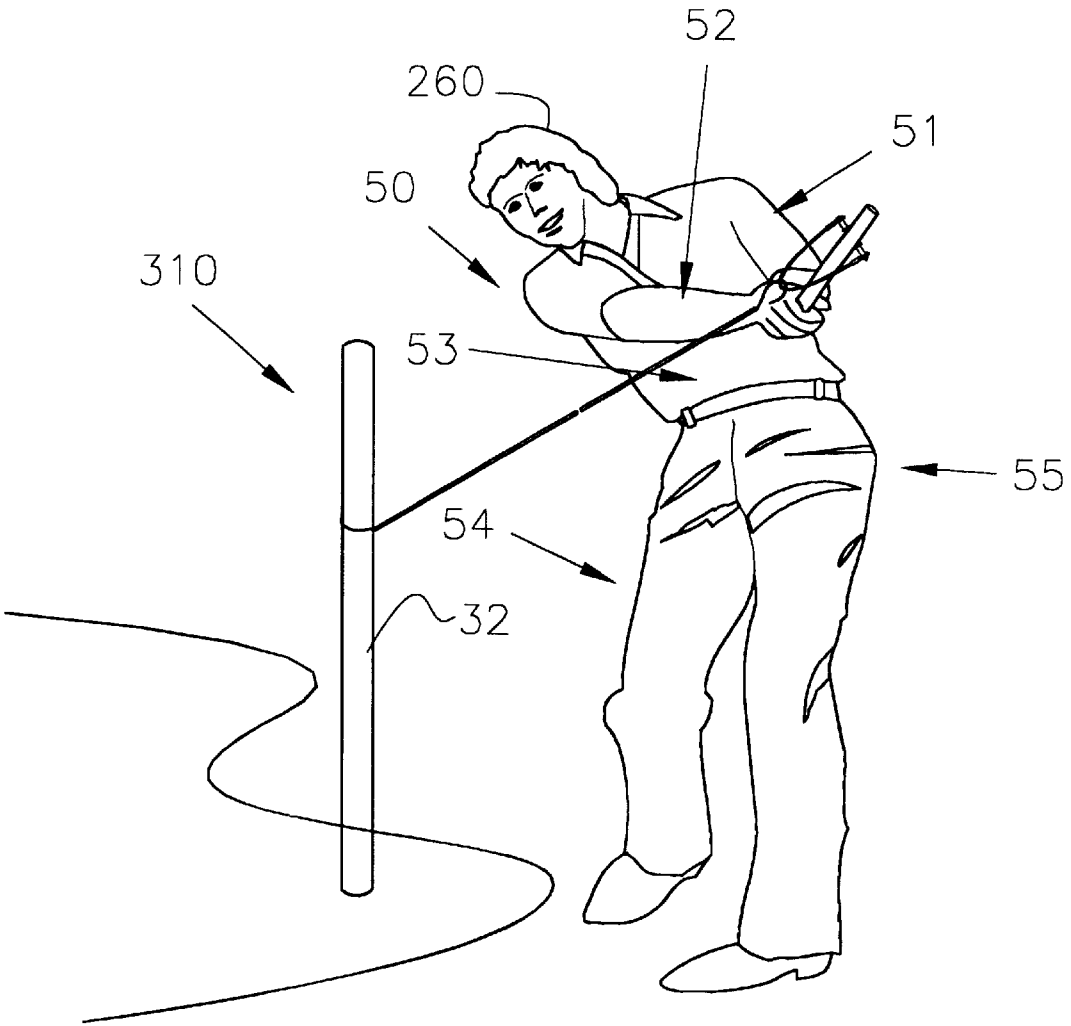
FIG. 11 is an elevational view showing a golf player using the training device of the invention.
Figure 12:
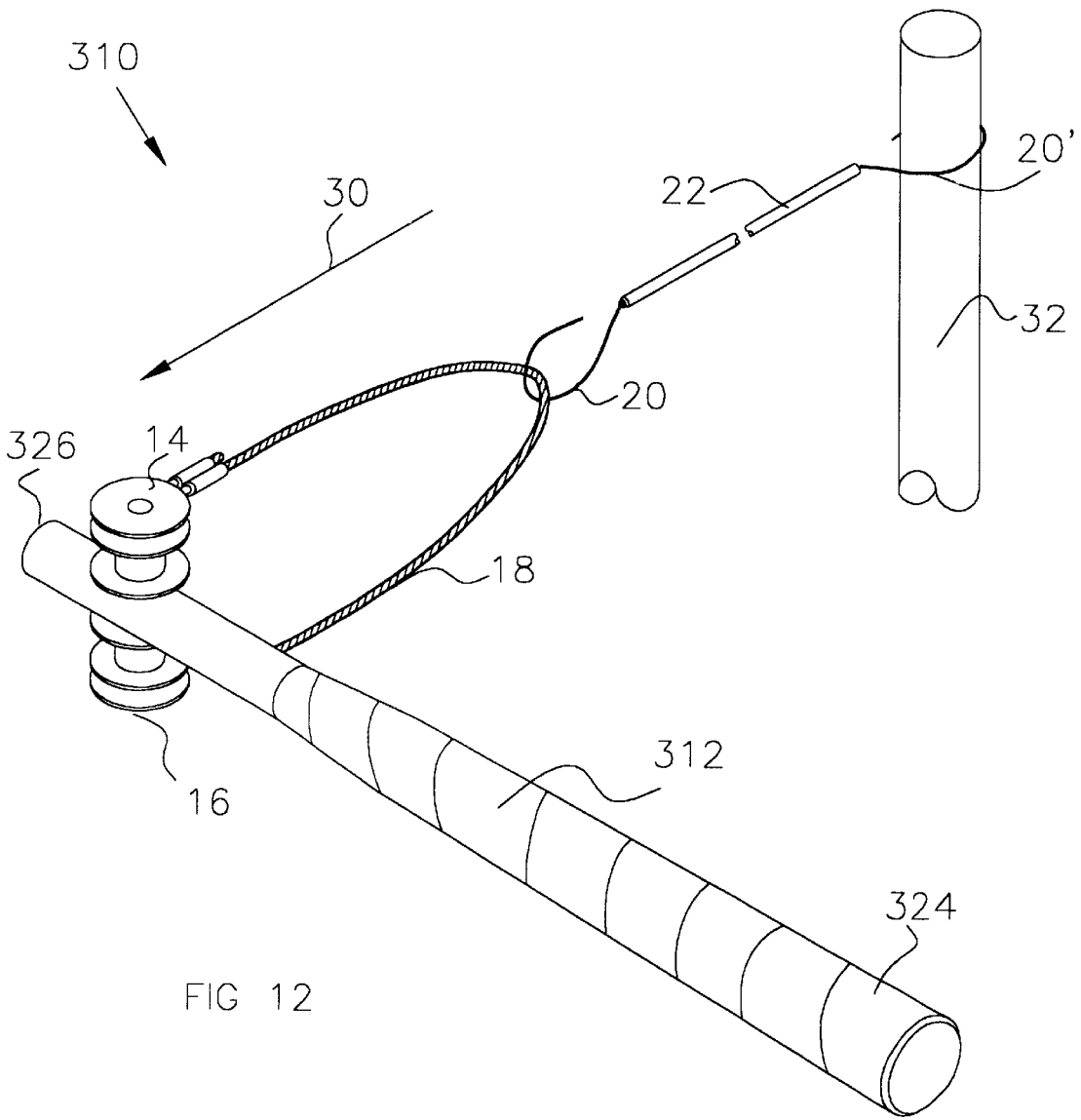
FIG. 12 is an isometric view of a first embodiment of a golf club handle in accordance with the invention.
Figure 13:
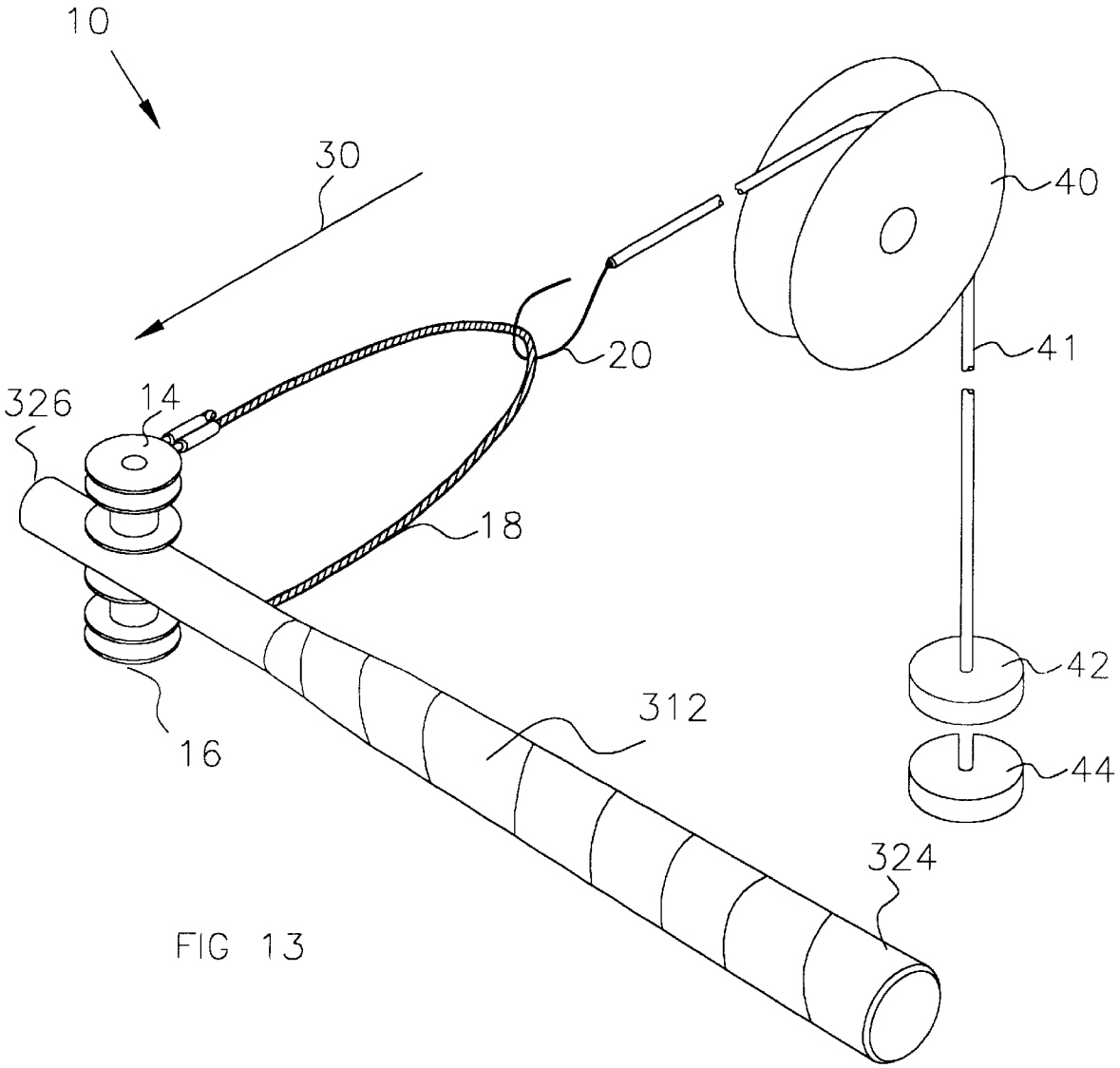
FIG. 13 is an isometric view of a second embodiment of a golf club handle in accordance with the invention.

The muscle conditioning effect of the invention in either of its embodiments is seen in FIGS. 3, 5, 8 and 11. Assuming a normal batting stance, batter 60, gripping the proximal end 24 of the training bat 12, must apply force against the inertial tension in cord 22. Repetitive motions by batter 60 produce both aerobic and/or isometric exercise for muscle groups 50 in the shoulders, in the upper arms 51, in the forearms 52, in the stomach 53, in the thigh leg muscles 54, and in the lower back/gluteus area 55. FIGS. 5, 8 and 11 show the same results for tennis, hockey and golf.

The attachment location of cord 22 on anchor pole 32 can be adjusted for each individual batter. By attaching the cord 22 at different heights on a fence, a batter may practice the "swing plane" that he/she prefers. A higher attachment gives a more downward swing plain. When using the power swing invention 10, the batter should swing 10 or more repetitions thereby quickly developing the "quick twitch muscle memory".

Figure 3:
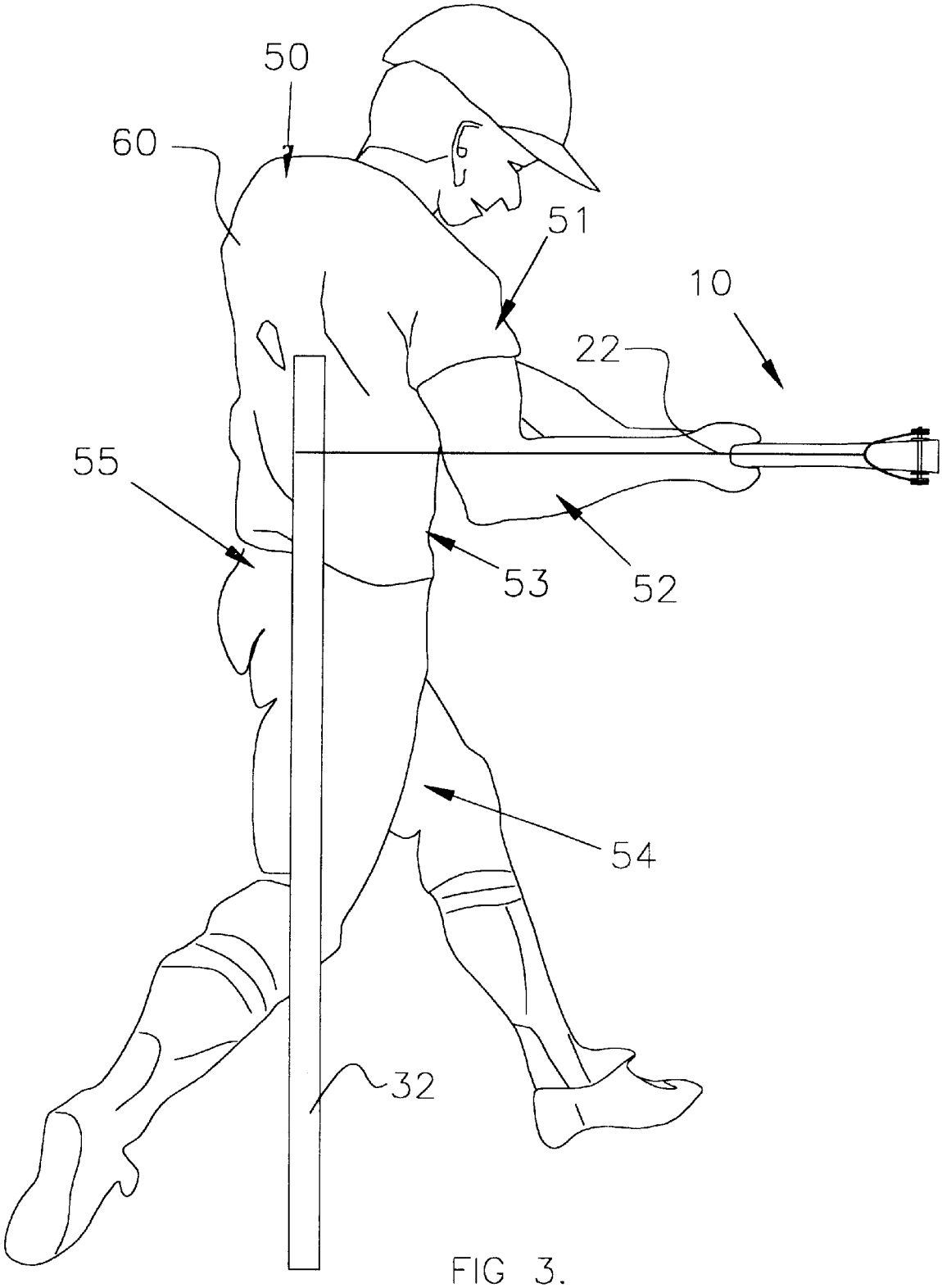
FIG. 3 is an elevational view showing a batter using the training device described herein.
Figure 4:
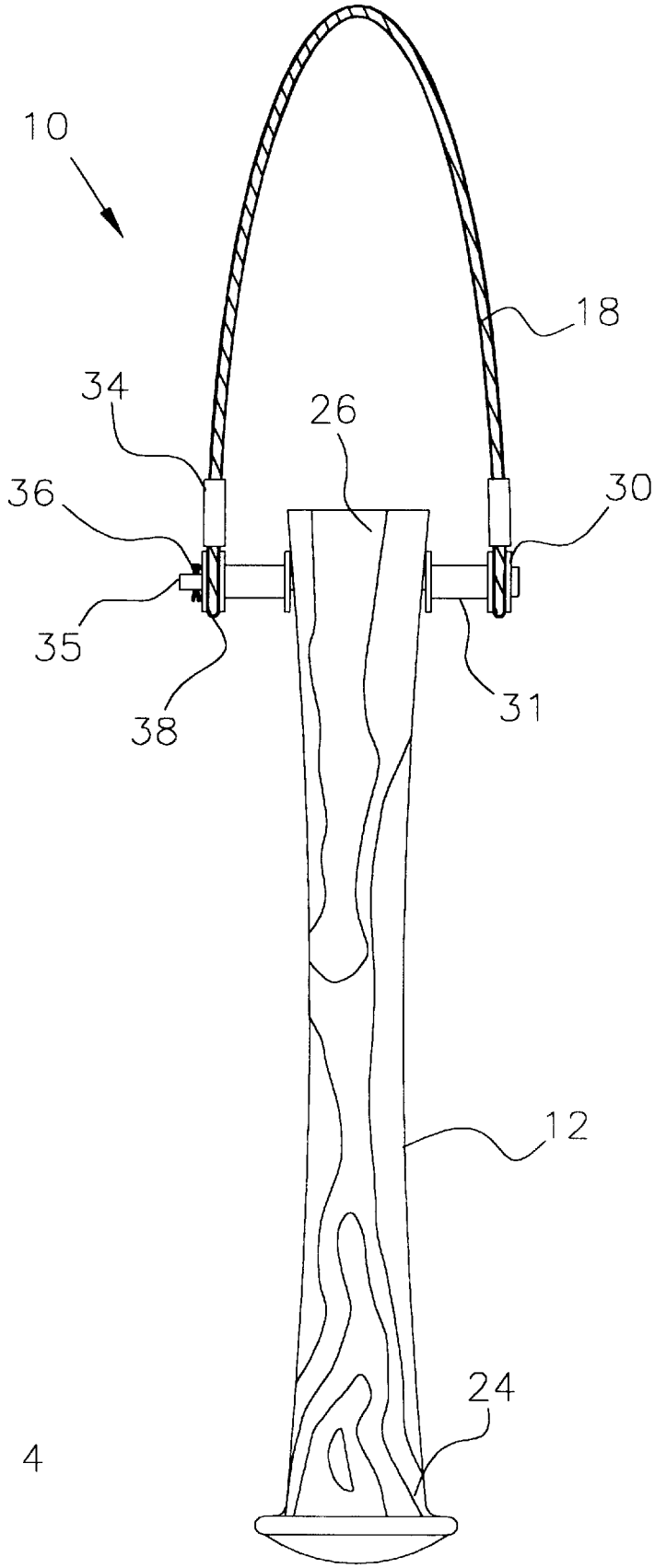
FIG. 4 is a plan view of a yoke assembly in accordance with the invention.

The pole 32 is shown as an example of an anchor, however, the most convenient and efficient anchoring point is the batting cage, or fence, where the cord 22 may be attached in an infinite number of locations to perfect a downswing, an upswing, or a horizontal swing as shown in FIG. 3. The pole 32 is more appropriate for the other applications as shown in FIGS. 5, 8, and 11. In FIG. 5 a tennis player is shown using both hands in hitting the tennis ball. In FIG. 8 a hockey player is shown with a typical hockey grip holding the hockey stick assembly 210. In FIG. 11 a golf player is shown using both hands with the golf system 310 to build up the appropriate muscles for golf.

Each of the embodiments include the same components described in relation to the baseball bat 12, that is, the swivel attachment points 14 and 16 and the yokes 18. The cords 22 would be sized appropriate for the required swing for the particular sport.

What is claimed is:

1. A sports training device comprising:

a truncated sports device, said sports device having a distal end and a proximal end, a shaft having a first end and a second end mounted through said distal end, a pair of swivel attachment points, each of said attachment points being attached to one of said first and second ends of said shaft at said distal end of said sports device, a yoke having two ends, each of said ends being attached in a rotatable position to one of said swivel attachment points, and an elastic cord having a first end and a second end, said elastic cord being rotatably attached to said yoke with a hook at said first end and attached with a hook to an anchor point at said second end, said elastic cord providing resistance to a force applied by the sports player to said sports device, thereby strengthening the muscles used directly in hitting a sports item.

2. A sports training device of claim 1 wherein said sports device consists of a truncated tennis handle.

3. A sports training device of claim 1 wherein said sports device consists of a truncated hockey stick handle.

4. A sports training device of claim 1 wherein said sports device consists of a truncated golf club handle.

5. A sports training device of claim 1 wherein said swivel attachment points comprise an assembly of washers and spacers mounted on opposite ends of said shaft attached through said distal end.

* * * * *